US005913953A

United States Patent [19]

Eve et al.

[11] Patent Number: 5,913,953

[45] Date of Patent: Jun. 22, 1999

[54] CAN OPENER APPARATUS FOR PULL-RING CONTAINERS

[76] Inventors: Joel Leslie Eve, 3988 Beethoven St., #12, L.A., Calif. 90066; Devora Ann Janke, 8200 Alverstone Ave., Los Angeles, Calif. 90045

[21] Appl. No.: 09/009,000

[22] Filed: Jan. 20, 1998

[51] Int. Cl.[6] ..... B67B 7/16

[52] U.S. Cl. ..... 81/3.55; 81/3.07

[58] Field of Search ..... 81/3.07, 3.36, 81/3.55, 3.09, 3.4, 3.57; 7/151; D8/18, 33, 40

[56] References Cited

U.S. PATENT DOCUMENTS

| | | | |
|---|---|---|---|
| D. 303,613 | 9/1989 | Carmody | D8/40 |
| D. 304,414 | 11/1989 | Ely | D8/18 |
| 1,368,038 | 2/1921 | Larsen | 81/3.55 |
| 1,461,151 | 7/1923 | Keeler | 81/3.07 |
| 2,624,489 | 1/1953 | Wishart | 7/151 |
| 4,391,167 | 7/1983 | Bergmeister | 81/3.57 |
| 4,416,171 | 11/1983 | Chmela et al. | 81/3.55 |
| 4,520,695 | 6/1985 | Sugiyama | 81/3.07 |
| 4,745,829 | 5/1988 | VanHoutte et al. | 81/3.55 |
| 5,095,777 | 3/1992 | Osmar et al. | 81/3.55 |
| 5,205,194 | 4/1993 | Rodey | 81/3.55 |
| 5,277,083 | 1/1994 | Madonia | 81/3.55 |

FOREIGN PATENT DOCUMENTS

| | | | |
|---|---|---|---|
| 3517310 | 11/1986 | Germany | 81/3.55 |
| 282093 | 11/1990 | Japan | 81/3.57 |

*Primary Examiner*—David A. Scherbel
*Assistant Examiner*—Joni B. Danganan

[57] ABSTRACT

A device for opening sealed cans of the type using a pull-ring to initiate the opening of the lid. The device consists of a cylindrical hollow tube having a handle on one end. On the end of the device opposite the handle, there is a flattened portion of the tube which is made to slip under the pull-ring for initial raising of the pull-ring from the container lid. In the approximate transverse center of the hollow tube, there are two oblong openings that run longitudinally along the surface of the tube. Proximate to the oblong openings, there is an inwardly protruding rivet-like structure. In use, one of the oblong openings, depending upon the hand preference, is placed over the pull-ring until the cylindrical body of the tool comes to rest on the rim of the container. As the opener is then rotated along the rim of the container, the oblong opening begins to bind upon the pull-ring. At the same time, the eye of the pull-ring slips over the end of the inwardly protruding structure which secures the pull-ring within the body of the opener. With continued rotation of the opener, the oblong opening binds more tightly upon the pull-ring causing an upward pulling and tearing of the container lid from the container top.

4 Claims, 4 Drawing Sheets

CAN OPENER APPARATUS FOR PULL-RING CONTAINERS

CROSS-REFERENCE TO RELATED APPLICATIONS

Not Applicable

STATEMENT REGARDING FEDERALLY SPONSORED RESEARCH OR DEVELOPMENT.

Not Applicable

REFERENCE TO MICROFICHE APPENDIX

Not Applicable

BACKGROUND OF THE INVENTION

1. Field of the Invention

The field of invention relates to can opening devices and more particularly relates to a new and improved opener apparatus for containers of the type having a lid intended to be separable from the base of the can by manipulation of a pull-ring attached to the lid.

Pull ring-type opening tabs are found on a variety of canned goods including soft drinks, other beverages, cat and dog food, nuts, canned meat, powdered milk, and fruit cups to name just a few. These types of cans require that the closure be opened by pulling the tab ring in an upward direction, thereby separating the container lid from the can. Continued pulling of the ring in the direction along the tear line, causes the container lid to be completely removed from the can.

The problem occurs because many persons including children, older people, and people who may have certain physical limitations; may find it difficult to open these containers without a mechanical advantage. Secondly, because the can tops and container lids are very sharp; persons run the risk of receiving a cut on the fingers and hands or breaking finger nails when opening these containers. Thus the need for a new and improved opener to provide a mechanical advantage to the user while at the same time providing a tool which will greatly reduce the risk of being cut and scraped. Many such devices designed to open such containers are found, in large part, among the following patent classes: 81/3.55, 3.09, 3.07, and 3.45.

2. Prior Art

Pop-top beverage containers such as those containing beer or soft-drinks, have lid portions with a small oval or round area that is opened to dispense the liquid contents of the container. Various devices have been suggested to assist in opening such containers including the devices shown in these following patents: U.S. Pat. No. 3,954,030 issued May 4, 1976 (Newton); U.S. Pat. No. 4,133,228 issued Jan. 9, 1979 (DePooter); U.S. Pat. No. 4,391,167 issued Jul. 5, 1983 (Bergmeister); U.S. Pat. No. 4,416,171 issued Nov. 22, 1983 (Chmela et al.); U.S. Pat. No. 4,745,829 issued May 24, 1988 (VanHoutte et al.); U.S. Pat. No. 4,911,038 issued Mar. 27, 1990 (Ferrin); U.S. Pat. No. 4,967,622 issued Nov. 6, 1990 (Phillips).

The above referenced patents were designed to assist in the opening of cans where the opening tab was manufactured in the center of the can top. Further, these devices are meant to assist the user in pushing the opening tab into the can or pushing the tab upward and away from the container opening. Third, these designs do not lend themselves easily to the opening of containers where the pull-ring is located adjacent to the edge of the can for the purpose of removing the entire container lid.

There is yet another can design in which a pull-ring or tab is riveted to the lid of the can adjacent to the edge of the can. Patents directed to devices to open these types of containers are relevant to our invention and include: U.S. Pat. No. 1,368,038 issued Feb. 8, 1921 (Larsen); U.S. Pat. No. 2,656,065 issued Oct. 20, 1953 (Breeze); U.S. Pat. No. 4,241,626 issued Dec. 30, 1980 (Hall); U.S. Pat. No. 5,018,409 issued May 28, 1991 (Bittel); U.S. Pat. No. 5,095,777 issued Mar. 17, 1992 (Osmar et al); U.S. Pat. No. 5,205,194 issued Apr. 27, 1993 (Rodey); U.S. Pat. No. 5,277,083 issued Jan. 11, 1994 (Madonia); U.S. Pat. No. 5,309,794 issued May 10, 1994 (Kelly); U.S. Pat. No. 5,390,567 issued Feb. 21, 1995 (Martorell); U.S. Pat. No. 5,555,778 issued Sep. 17, 1996 (Otters et al).

Some of the devices referenced by the artwork in the immediate foregoing list of patents have certain inherent disadvantages. The devices described in the prior art that utilize an external hook to grab the pull-ring and effect the raising and subsequent tearing of the container lid; run the risk of having the container lid being flipped or catapulted off the tool. This is especially apparant at the moment the container lid finally separates from the container top. This is due to the fact that the metal of the container lid has a memory and tries to spring the lid back to its flattened shape. Therefore, this action may put the user at some risk for injury. Secondly, some of the devices are designed to use only the center of the container lid or only one side of the container rim as the fulcrum point. Hence, these devices may be lacking in stability and lacking in ability to provide the best leverage for the user. Further, a few of the devices described in the art of the above referenced patents are flat and unidimentional in shape and do not lend themselves to a continuous rolling motion across the rim of the containers to effect lid separation.

In the summary below, we will point out how the present invention overcomes the disadvantages described by the prior art as well as listing the objectives of this new and improved opener device.

SUMMARY OF THE INVENTION

In the light of the previously mentioned disadvantages inherent in the known types of pull ring opener structure now present in the prior art, the present invention provides a new and improved can opener apparatus which has all the advantages of the prior art pull-ring opening apparatus and none of the disadvantages.

To achieve this, our invention provides a cylindrical hollow tube with a leverage handle on one end, two oblong longitudinal openings on the surface of the hollow tube, an inward protruding structure proximate to the oblong openings, and a flattened portion of the hollow tube at the end farthest from the handle. The disadvantages of the designs found in the previous art, are overcome by the following summary of the present invention's method of use and design.

Using the flattened end of our tool opposite the handle end, the pull-tab is initially raised from the container lid. With the pull-ring tab in a slightly raised position, one of the oblong openings, depending upon the hand preference, is placed over the pull ring until the body of the tool comes to rest fully across the entire top of the container. As the opener is rotated in a direction away from the pull-ring end of the container, two significant and important actions occur: First, as the oblong opening binds upon the pull-ring, the opener is brought into firm contact with the container rim. Since the entire container rim serves as the fulcrum; the opener is more stable upon the container and provides better leverage as the tool is rotated over the top of the container. Secondly, the inward protruding structure protrudes through the eye of the pull ring and therefore aids in securing the pull-ring within the body of the opener. Therefore, the chance of the pull-ring being flipped or catapulted out of the opener is eliminated. With continued rotation of the opener, the pull-ring and container lid are lifted upward and away from the container top until complete separation of the lid is effected.

It is therefore an objective of our present invention to provide a new and improved can opener tool which has all the advantages of the prior art can openers and none of the disadvantages.

It is another objective of the present invention to provide children, older persons and persons with various physical limitations; a more stable tool with improved mechanical advantage in opening such pull-ring containers.

A third important objective of the invention is to provide an opener that reduces the risk of cuts and scrapes to the fingers and hands as well as reducing the risk of breaking finger nails.

Yet another important objective of the present invention is to provide a tool that is usable on a wide range of container sizes and shapes.

It is a further objective of this invention to provide a new and improved opener, simple in designs easily manufactured, very low in maintenance, and thus can be sold inexpensively to the public.

For a more complete understanding of our invention, its operating advantages and the specific objectives attained by its uses, reference should be made to the accompanying drawings and the descriptive material found in the section entitled "detailed description of the invention".

DETAILED DESCRIPTION OF THE INVENTION

Figure 1:
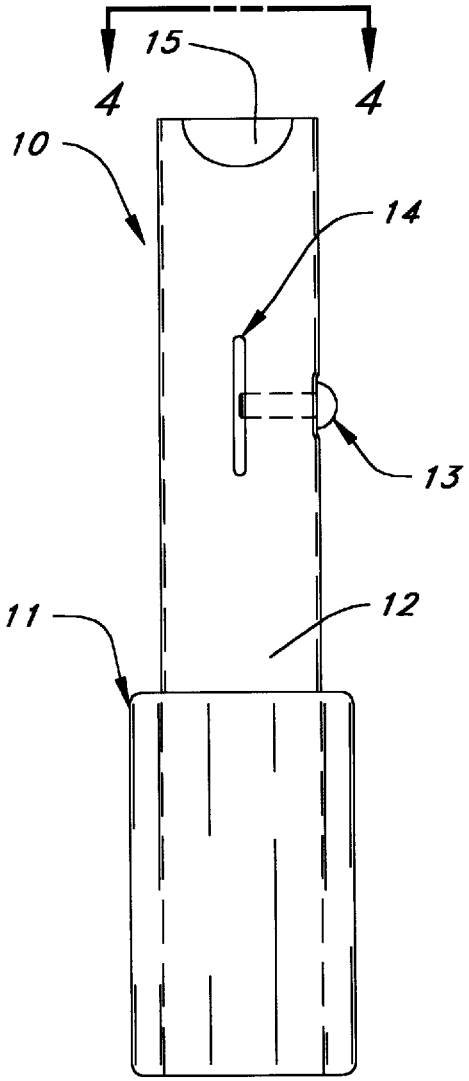
FIG. 1 is a longitudinal view of the opener showing the oblong opening, flattened portion of the tube end; and inward protruding structure.
Figure 2:
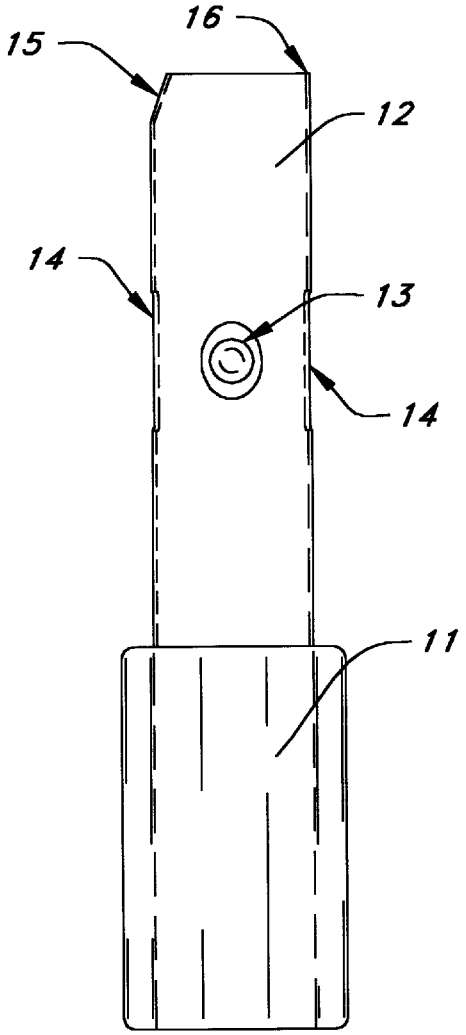
FIG. 2 is a side view of the opener rotated 90 degrees relative to FIG. 1.

We refer now to the drawings, and in particular to FIGS. 1 to 6 inclusive, a new and improved can opener apparatus designed for cans with pull-ring opening designs. For reference, our invention is generally designated by the reference numeral 10.

Refering to FIG. 1. Specifically, the can opener apparatus 10 of the present invention essentially comprises an elongated tubular shaft 12 which is hollow on the inside. The thickness of the shaft wall 16, shown in FIG. 2, may vary considerably and is within the scope of our invention. The shaft 12 of opener 10 may be metal or any other suitable material that will withstand the stress of lever action against the shaft. The shaft 12 may be circular in shape as shown in the sectional view of FIG. 5 or elliptical in shape, and such variation in sectional shape is within the intent and scope of this invention.

Refering now to FIG. 1. One end of opener 10 is fitted with a handle grip 11 which may be cylindrical, tapered, bulbous, or any other configuration to fit the hand comfortably. Variations in the shape and size of said handle grip 11 are within the scope and intent of this invention. Further, the handle 11 may be wood, plastic, rubber, or any other suitable material; and said handle may be separate from or unitary and integral with shaft 12.

The end of shaft 12 distal to the end fitted with the handle grip 11, has a flattened section 15 shown in FIGS. 1, 2, 3, 4, and 6. This shape of this flattened section may be achieved by pressing, stamping, or molding the shape into the design of the device. The use of this flattened section 15 will be detailed in subsequent paragraphs below.

Figure 5:
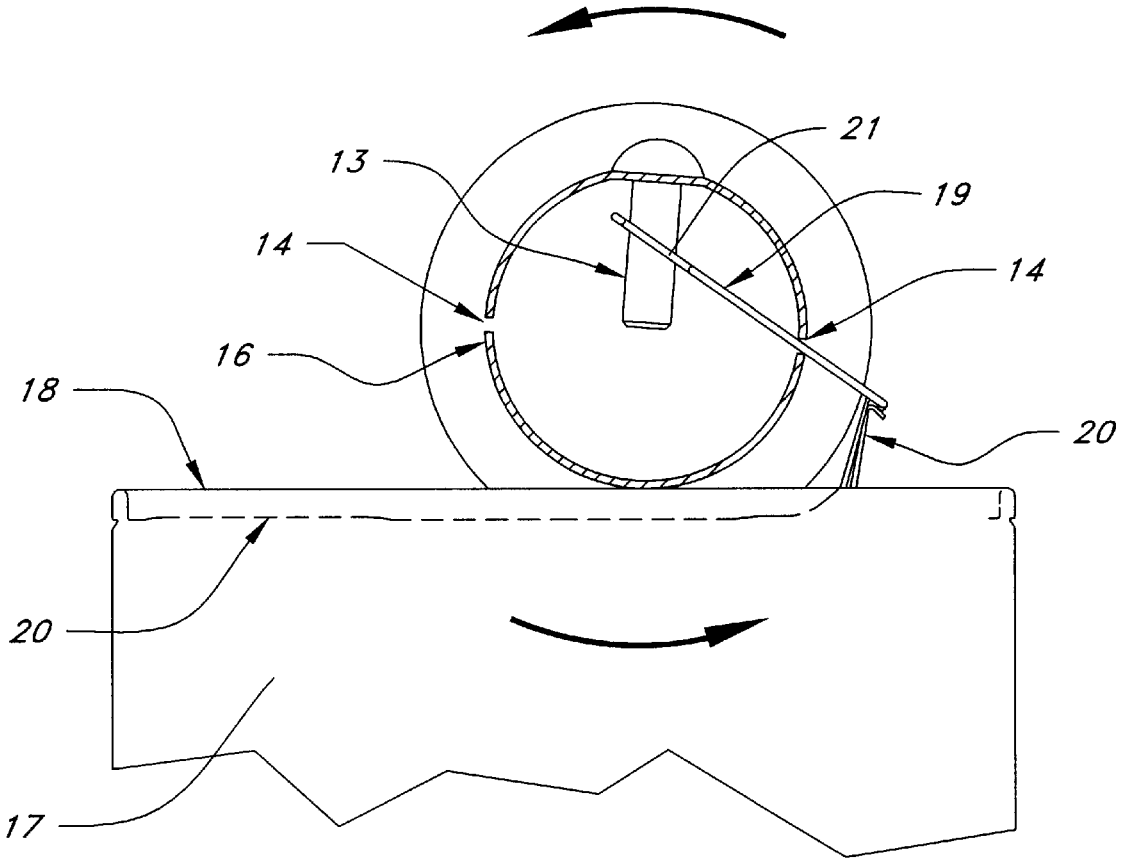
FIG. 5 is an enlarged, cross-sectional view at the transverse center of the oblong opening taken substantially along the lines of 4—4 in FIG. 1. The opener in this view is rotated approximately 45 degrees beyond the view that is shown in FIG. 4.
Figure 6:
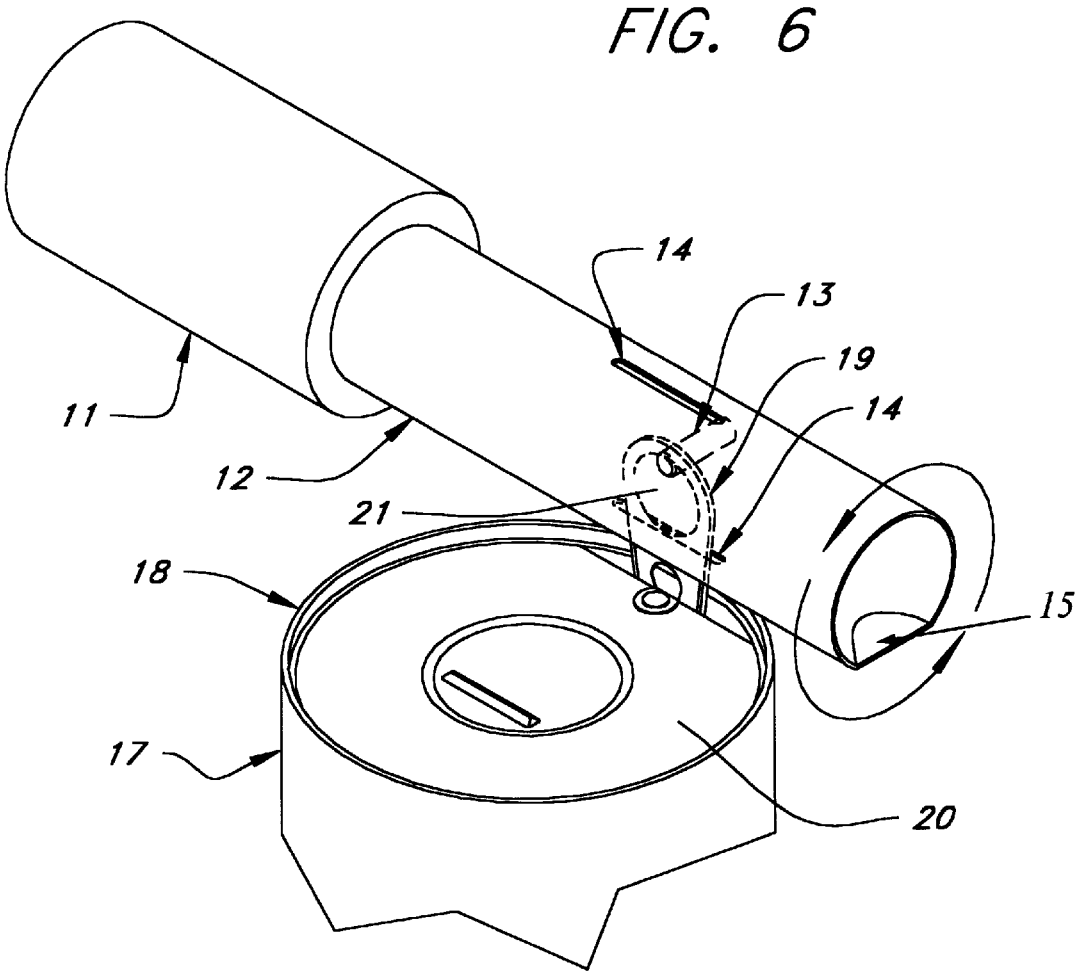
FIG. 6 is an elevational view showing of the invention being used in a second orientation relative to the container.

In the approximate transverse center of shaft 12 of tool 10, there are two oblong openings 14 which run longitudinally along the tube wall FIGS. 1, 2, 5, and FIG. 6 show oblong openings 14. These oblong openings may be cut, stamped or otherwise milled into the tube wall. Further, variations in the size and shape of said oblong openings 14 are within the scope and intent of the present invention. The purpose of these oblong openings are to receive the pull-ring 19 of the container lid 20 as shown in FIG. 6. The function of oblong openings 14 will be described in detail in subsequent paragraphs below.

Referring again to FIG. 1. In the approximate transverse center of shaft 12 at approximately a 90 degree orientation to each of the oblong openings 14 is a rod-like structure 13 which protrudes into the hollow body of shaft 12 perpendicularly to the tube wall 16. Further, said structure 13 may be rivet-like, bolt-like, or screw-like in nature; and such variations are within the scope and intent of this invention. Said inward protruding structure 13 may be fastened to the tube wall 16 by means of a threaded hole, pop-rivet, or spot-weld. Further, the length and diameter of structure 13 may vary and is within the scope and intent of this invention.

Refering to FIGS. 5 and 6. The purpose of inward protruding structure 13 is to protrude through the eye 21 of pull-ring 19 of the container lid 20, and secures the pull-ring 19 within the body of the opener 10. The exact function of structure 13 will become apparent as described in the use of the opener 10 below.

Figure 3:
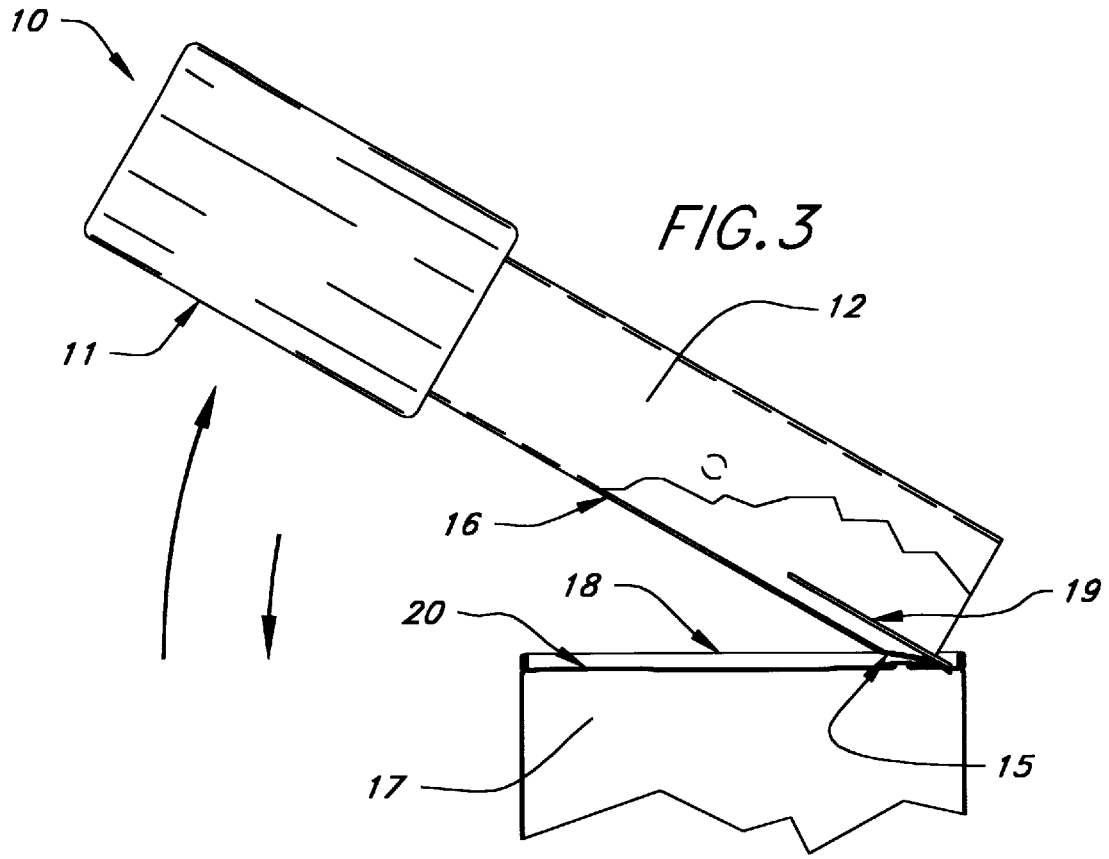
FIG. 3 is a side view of the tool showing the first upward separation of the pull-ring from the container lid. The far end of the opener opposite the handle, is shown in cut-away to better illustrate the position of the pull-ring.

In usage: Refer to FIG. 3. The flattened section 15 of opener 10 is placed under the free end of pull-ring 19 which is attached to container lid 20. With an upward and downward motion of the handle grip 11, as shown by the direction of the arrows, upward movement and initial separation of pull ring 19 from container lid 20 is effected.

Figure 4:
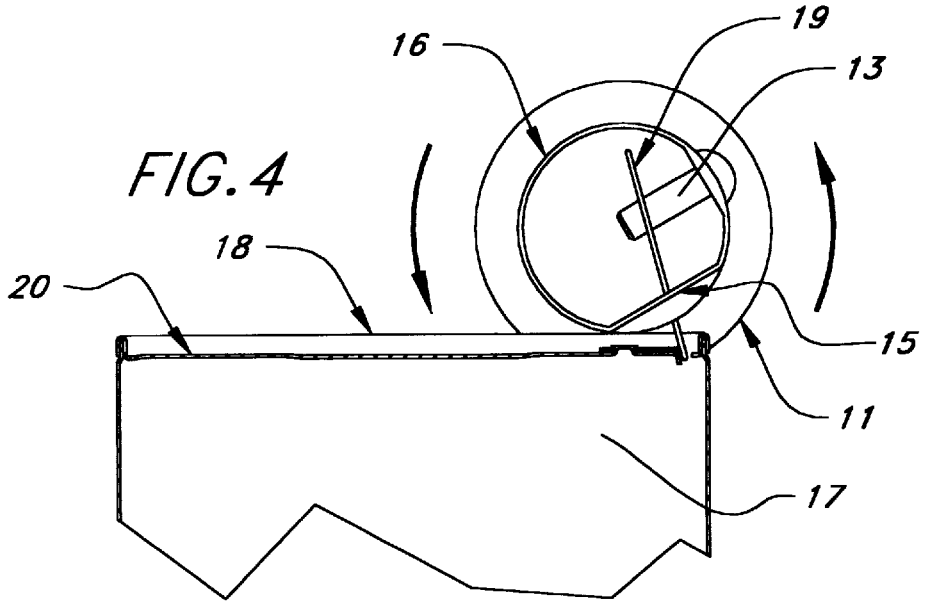
FIG. 4 is a view of the tool from the open end, taken along the lines of 4—4 of FIG. 1 in the direction indicated by the arrows. In this view, the tool is shown rotated just pass the plane line of FIG. 1.

Referring now to FIG. 4 and FIG. 6. One of the oblong openings 14, depending upon hand preference, is placed over the pull-ring 19 which is now in an upright position. The shaft 12 is now resting firmly on the rim 18 of the entire container 17 as shown. Refering to FIG. 4 and FIG. 5, as the opener is rotated in the direction shown by the arrows, the sides of the oblong opening 14 begin to bind upon the pull-ring 19. At the same time oblong opening 14 begins to bind on pull-ring 19, the eye 21 of pull-ring 19 slips over the end of the inward protruding structure 13. This latter and important action, aids in securing of the pull-ring within the body of the opener. Refering again to FIG. 5; further rotation of the opener causes the oblong opening 14 to bind more tightly upon the pull-ring 19. As shown in the drawing, upward motion of the pull-ring 19 is accomplished along with the subsequent tearing and lifting of the container lid 20 until said lid is completely removed from the can.

In conclusion of this section; as there are many changes and modifications that will occur to persons who are skilled in the art, it is not our desire to limit the invention to the exact construction and operation that has been shown and described in the above paragraphs. Accordingly, all suitable modifications may be resorted to, falling within the scope of our invention.

What is claimed is:

1. A can opener apparatus for pull-ring sealed containers comprising:

an elongated hollow tube with first and second ends;

a handle means attached to the first end of said hollow tube;

the hollow tube including a flattened portion on the second end;

two oblong openings in the approximate transverse center of said hollow tube running in a longitudinal direction along the surface of said hollow tube; and an inwardly protruding structure proximate to the oblong openings and orientated at approximately a 90 degree angle to each of the oblong openings.

2. The opening device recited in claim 1, wherein said hollow tube is circular in cross-section.

3. The opening device recited in claim 1, wherein said hollow tube is elliptical in cross-section.

4. The opening device recited in claim 1, wherein said handle means is integral and unitary with said hollow tube.

* * * * *